US007696886B2

(12) United States Patent
Lai

(10) Patent No.: US 7,696,886 B2
(45) Date of Patent: Apr. 13, 2010

(54) ELECTRONIC SEAL WITH RADIO FREQUENCY IDENTIFICATION

(75) Inventor: Simon Lai, Banciao (TW)

(73) Assignee: Alexan Co., Ltd., Banciao (TW)

( * ) Notice: Subject to any disclaimer, the term of this patent is extended or adjusted under 35 U.S.C. 154(b) by 371 days.

(21) Appl. No.: 11/984,131

(22) Filed: Nov. 14, 2007

(65) Prior Publication Data

US 2009/0121878 A1 May 14, 2009

(51) Int. Cl.
*G08B 13/14* (2006.01)

(52) U.S. Cl. ..... 340/572.7; 340/572.1

(58) Field of Classification Search ..... 340/572.1, 340/572.3, 572.7, 572.8, 572.9; 439/188, 439/944; 292/307 R
See application file for complete search history.

(56) References Cited

U.S. PATENT DOCUMENTS 5,076,797 A * 12/1991 Moulton ..... 439/188
7,215,250 B2 * 5/2007 Hansen et al. ..... 340/572.9
7,298,274 B2 * 11/2007 Chen et al. ..... 340/572.8
2007/0222232 A1 * 9/2007 Held ..... 292/307 R

* cited by examiner

*Primary Examiner*—Van T. Trieu
(74) *Attorney, Agent, or Firm*—Bacon & Thomas, PLLC

(57) ABSTRACT

The electronic seal with radio frequency identification of the present invention comprises a lock cylinder and a lock latching plug to form an integral lock portion, which having RF chip, RF antenna with associated electric circuits, conductors and RF chip, wherein the lock cylinder comprises a metal lower antenna tube and a metal upper antenna tube to form each opposite pole of the dipole antenna. With relay conductor and propagating conductor being built in the central hollow space to connect with RF antenna and RF chip respectively, the RFID system is activated if lock cylinder and lock latching plug joint together.

7 Claims, 6 Drawing Sheets

ELECTRONIC SEAL WITH RADIO FREQUENCY IDENTIFICATION

TECHNICAL FIELD

The present invention relates to an electronic seal with radio frequency identification, particularly pertaining to the passive electronic seal used in container with dual function of conventional bullet-shaped electronic container lock and radio frequency identification (RFID) in an integral apparatus.

PRIOR ARTS

The purpose of the conventional container seal is to prevent the risk of enclosed commodity from being stealthily exchanged or stolen. But, due to the necessity of manual examination by the human eye inspect in such conventional container seal, the failure in expected function results in the manual negligence and mistake or forgery by other people is unavoidable. Currently, according to the official procedure in the manual transportation escort, the customs personnel should visit different customs territory to perform inspection that not only the administration cost is increased but also the time of customs clearance is delayed. Therefore, some business company develops an electronic seal of container lock together with Radio Frequency Identification (RFID) to reduce the risk of container enclosed commodity from being stealthily exchanged or stolen by means of the uniqueness and difficulty in forgery features in the RFID system because the theft-alert RF chip therein will send out the radio signal to back-end processing system for process via the associated reader. Such radio frequency identification RFID systems are categorized into two kinds as below:

(A): Active Electronic Seal: (having built-in power supply)
- Feature: erasable memory, repeatability in use
- RF signal: duplex (transmitting and receiving)
- Range: valid more than 50 meters
- Function: system will alert the abnormal status of being destroyed or invades if the container associated is improperly opened
- Cost: comparative high
- Size: comparative large
- Maintenance: need timely replacement of battery (if used) for recycling.

(B): Passive Electronic Seal: (no built-in power supply)
- Feature: ROM memory, non-repeatability in use
- RF signal: simplex (reflecting)
- Range: valid less than 50 meters
- Function: system will alert the abnormal status of failure if the electronic seal is improperly opened
- Cost: comparative low
- Size: comparative small
- Maintenance: no battery in use For example, the drawback in the "RFID electronic seal and system using the RFID electronic seal" of U.S. Pat. No. 7,202,788 patent is that the RFID will be malfunction if the lock is directly cut or broken. The drawback in the U.S. patent application Ser. No. 11/211,627 is that neither having RFID emitting device built-in nor having simple effective antenna, whose antenna is a spiral metal coil with short valid range and susceptible to EMF noise interference. Most radio signal is communicated via air atmosphere and transmitted/received via antenna as well as relayed to the associated telecommunication electronic device via transmission cable, mostly coaxial cable to reduce the signal attenuation and better ration in signal to noise by shielding and suppressing the EMF noise interference.

As shown in the FIG. 6, the common structure of the current coaxial cable comprises a metal main core conductor, a polyethylene (PE) inner dielectric insulator, a metallic mesh shield and a polyvinyl chloride (PVC) outer insulation sheath, wherein, said metallic mesh shield can shield and suppress the EMF noise interference to enhance the ratio of signal to noise, but polyethylene (PE) and polyvinyl chloride (PVC) are material of environmental pollution with long-lasting adverse effect. Even the "Multi-frequency band antenna" of U.S. Pat. No. 6,421,024, it still has such drawback in using plastic material though replacing the coaxial cable by a cable enclosed by a metal tube.

In view of the requirement in strict control and management for daily import/export commodity with the advent of the global consensus in environmental protection and wireless communication as well as the increasing quantity of the international cargo transportation, the computerization in all process involving port-bound cargo transportation and cargo management become critical and urgent to tackle more complicated international environments, especially under mood of global anti-terrorism. A feature functional electronic seal will create following effects:

(a): productively reduce the manpower and cost in the manual transportation escort.

(b): effectively diminish the risk in container enclosed commodity from being stealthily exchanged or stolen.

(c): farther transportation distance, more convenient in use, increase market share.

(d): decrease usage of plastic material to achieve cost-saving and environment-protective effects.

Therefore, to innovatively design a simple construction, easy operation and marketable electronic seal becomes the primary target of the present invention.

SUMMARY OF THE INVENTION

So, the primary object of the present invention is to create an electronic seal with feature of far RF transmission range and unsusceptible to EMF noise interference as well as having beautiful product appearance. The other object of the present invention is to create an electronic seal with effect of endurable robust and solid construction as well as energy-saving and environmental protection.

In order to achieve the aforesaid objects, the lock cylinder and lock latching plug, which forms the integral lock portion of the present invention, comprises RF chip, RF antenna with associated electric circuits, conductors and RF chip to form a RFID system. If the lock cylinder and lock latching plug are separated, both of the built-in RF chip and RF antenna are then disconnected so that the DFID system becomes failed in function. Wherein, the signal transmission between RF chip and RF antenna is designed into coaxial feeding transmission manner with feature of shielding and suppressing EMF noise interference. The upper antenna tube and innermost waveguide pipe are coaxially sleeve construction with associated central relay conductor, which will electrically connect with (propagating conductor) to simplify the construction without loss of expected purpose.

Comparing with the conventional technology of the prior arts, innovative idea of simplifying construction is hidden in the coaxially sleeve construction of the (upper antenna tube) and innermost (waveguide pipe), which not only operates as an antenna pole but also serves as a part of lock cylinder as well as functions as switch of electrical connection with all mating components in the lock latching plug. Thus, the expected objects of decreasing usage of plastic material to have cost-saving, energy-conservation and environment-protective effects can be achieved.

DETAILED DESCRIPTION OF THE PREFERRED EMBODIMENTS

In order to facilitate your honorable examiners have better understanding the technological contents of the present invention, the detailed description for the preferred exemplary embodiment will be presented below with drawings associated.

Figure 1:
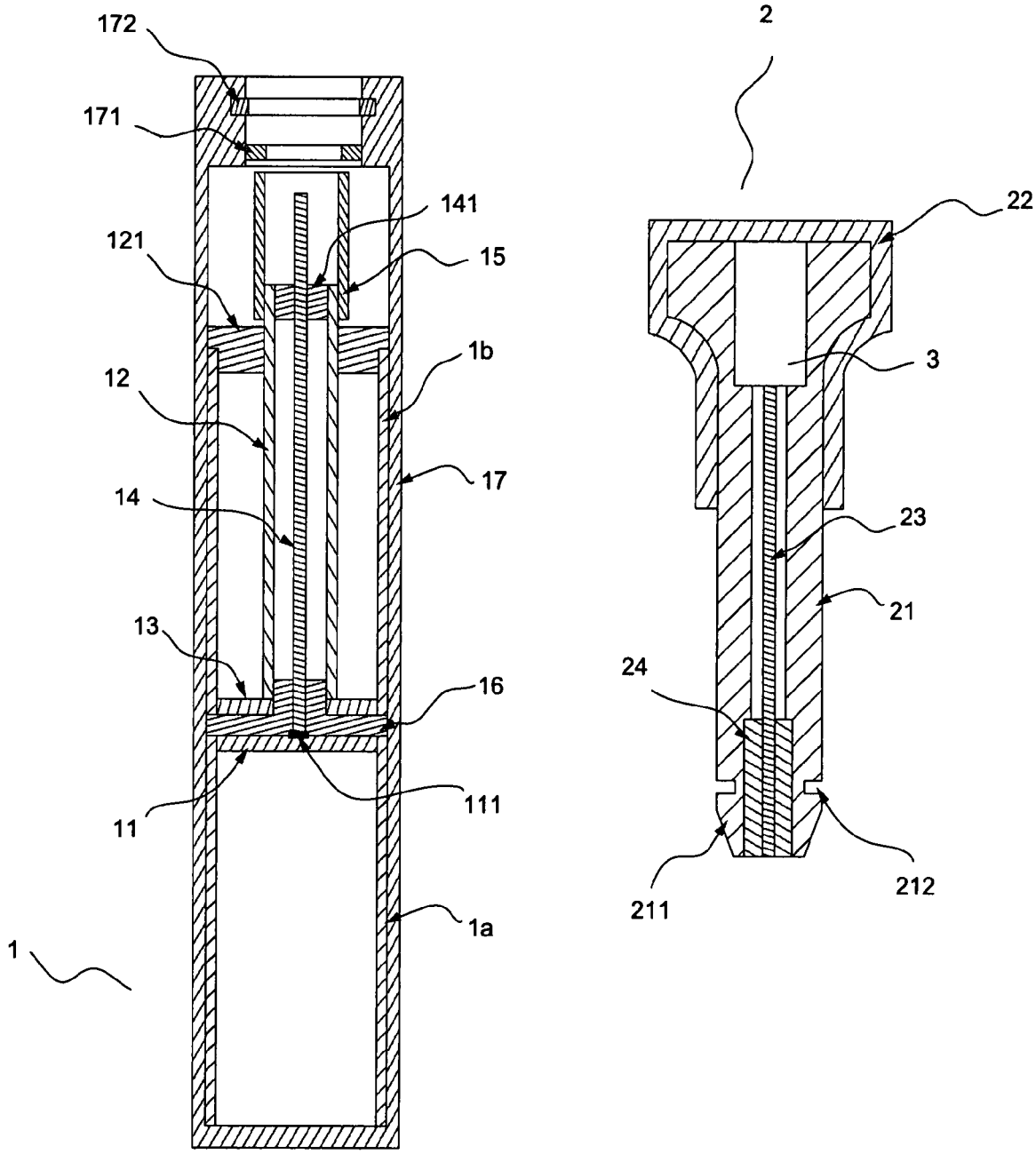
FIG. 1 is the illustrative schematics showing the structure for a preferred exemplary embodiment of the present invention.

The FIG. 1 is the illustrative schematics showing the structure for a preferred exemplary embodiment of the present invention. Please refer to other drawings attached for cross reference. From these drawings clearly shown, the Electronic seal with radio frequency identification of the present invention mainly comprises a lock portion as well as a RF chip 3 and RF antenna 4 therein. The lock portion comprises a lock cylinder 1 and a lock latching plug 2 so that both of which can be interlocked as a lock in locking manner.

The lock cylinder 1 comprises a metal lower antenna tube 1*a* and a metal upper antenna tube 1*b* together with an insulation terrace gasket 16 and a barrel shell 17 surrounding outer, disposed on the lower end of said upper antenna tube 1*b* is a RF feed disk 11, whereon a RF feed point 111 is indented in the center; centrally suspended inside of said upper antenna tube 1*b* is a metal waveguide pipe 12 having its lower end firmly fixed a coupling washer 13 to joint with said upper antenna tube 1*b* such that its upper end protruding over said upper antenna tube 1*b*.

A rigid metal relay conductor 14, which being centrally positioned inside of said waveguide pipe 12 by a insulation ferrule 141, has its lower end connected to the RF feed point 111, and has its upper end protruding over said waveguide pipe 12. With support by a insulation collar gasket 121, on the upper rim of said waveguide pipe 12 is a receptacle chuck 15 that is to be connected with external electronic device for feeding coaxial signal inwardly. On the upper internal circumference of said upper antenna tube 1*b* are formed by a C-shaped clip 171 and an O-ring water-jacket 172. The lock latching plug 2 comprises a latching butt cap 22 and a wrapped-in hollow metal column lock shank 21, which is formed by a lower truncated cone-shaped bevel reed tang 211 end with a groove rim 212 and upper breech butt enclosing a RF chip 3 with associated electric circuits. With support by a insulation cylinder spacer 24, centrally positioned in the hollow space of said column lock shank 21 is a rigid metal propagating conductor 23, which electrically connects to said RF chip 3 by its upper end.

Figure 3:
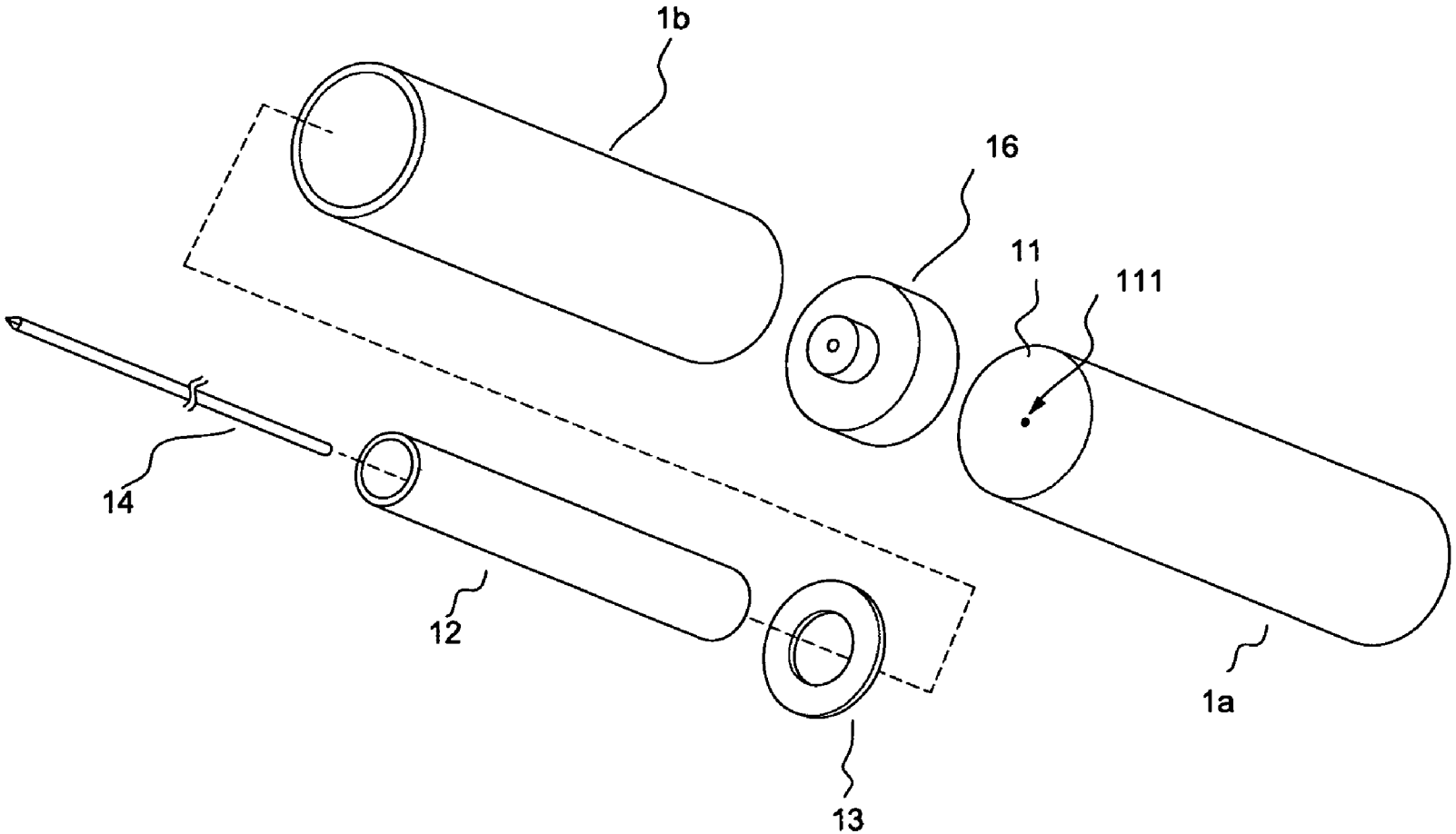
FIG. 3 is the illustrative schematics showing the structure for the antenna of the present invention.

As shown in the FIG. 3, a Radio Frequency Identification RFID comprises a RF chip 3, which is inset in the lock latching plug 2, and a RF antenna 4 which is encompassed by the lock cylinder 1. By means of electrical connection of the relay conductor 14 and propagating conductor 23, both of the RF chip 3 with associated electric circuits and RF antenna 4 build an integral radio transmitting apparatus for sending radio signal out.

Figure 2:
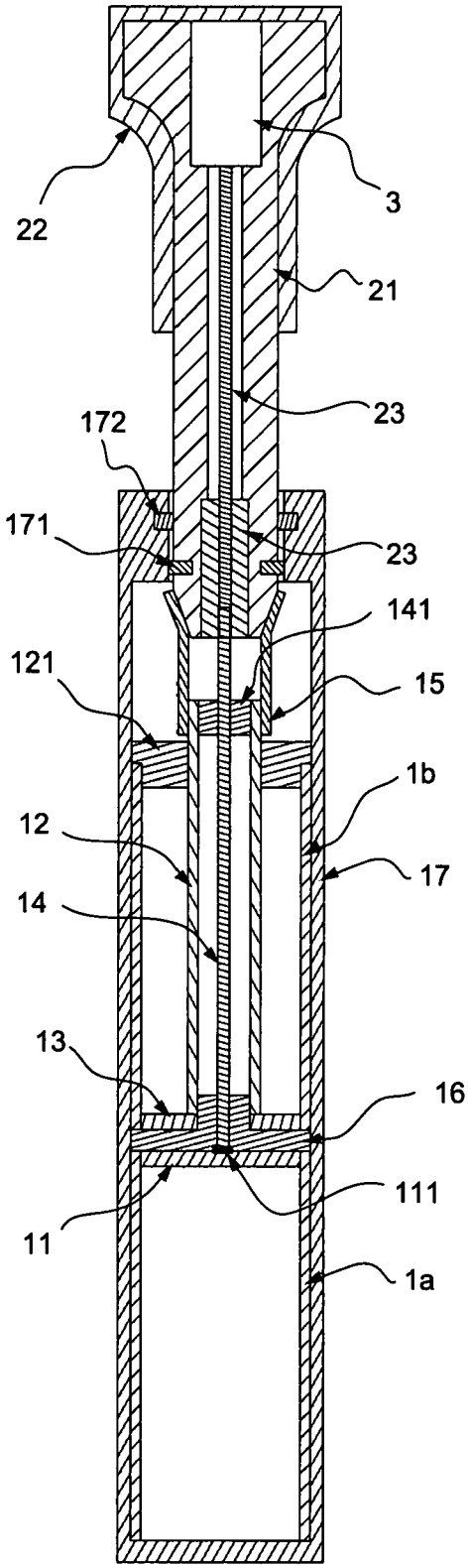
FIG. 2 is the illustrative schematics showing the assembly for a preferred exemplary embodiment of the present invention.

As shown in the FIG. 2 for practical application, when the bevel reed tang 211 of the lock latching plug 2 is forcedly inserted into the receptacle chuck 15 of the lock cylinder 1 for securely interlocking each other by means of buckling between the C-shaped clip 171 and groove rim 212. Under such interlocking manner between lock latching plug 2 and lock cylinder 1, both pairs of the relay conductor 14 and propagating conductor 23 as well as waveguide pipe 12 and column lock shank 21 are electrically connected likewise; besides, the water or moisture is prevented from getting in by means of the O-ring water-jacket 172 cinching on the column lock shank 21.

Both of the lock cylinder 1 and lock latching plug 2 can serve dual functions as lock and switch since they have features in both of interlocking/unlocking mechanism and electrical connection/disconnection. Namely, when they are inset together, it means the (lock portion) is mechanically interlocked and the radio transmitting system is electrically switched on so that the information such as commodity name, item, quantity and the like of radio signal sending out from the RF chip 3 will be propagated to the RF antenna 4 via propagating conductor 23 and relay conductor 14 to radiate into surrounding space for being captured by the associated radio signal reader and processed in the back-end processing system. Conversely, if they are separated by any way, it means the (lock portion) is mechanically unlocked and the radio transmitting system is electrically switched off into disable condition with no radio signal is detected by the associated radio signal reader so that RFID can alert the abnormal status happened.

Figure 4:
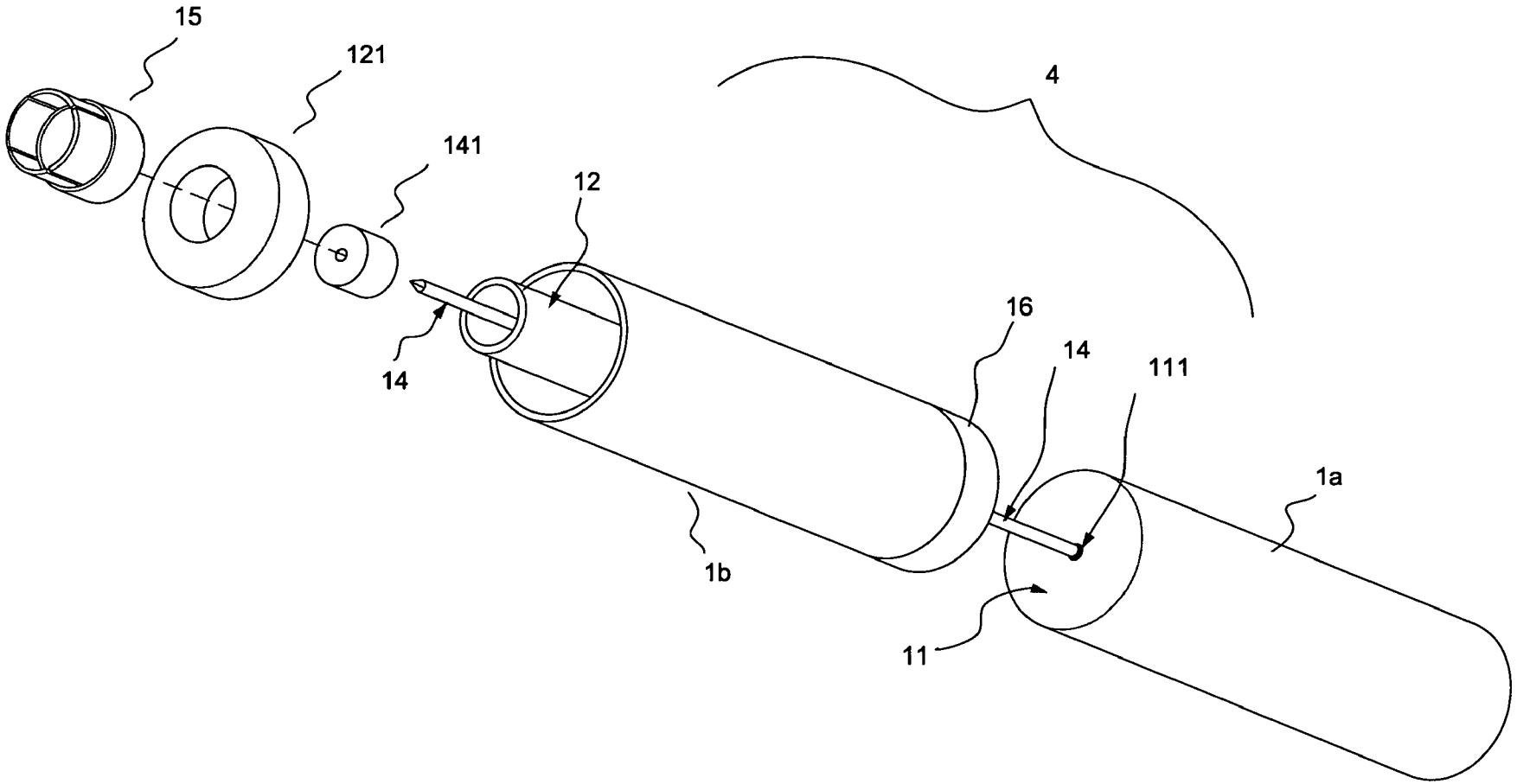
FIGS. 4 and 5 are the illustrative schematics showing the assembly steps for the antenna of the present invention.
Figure 5:
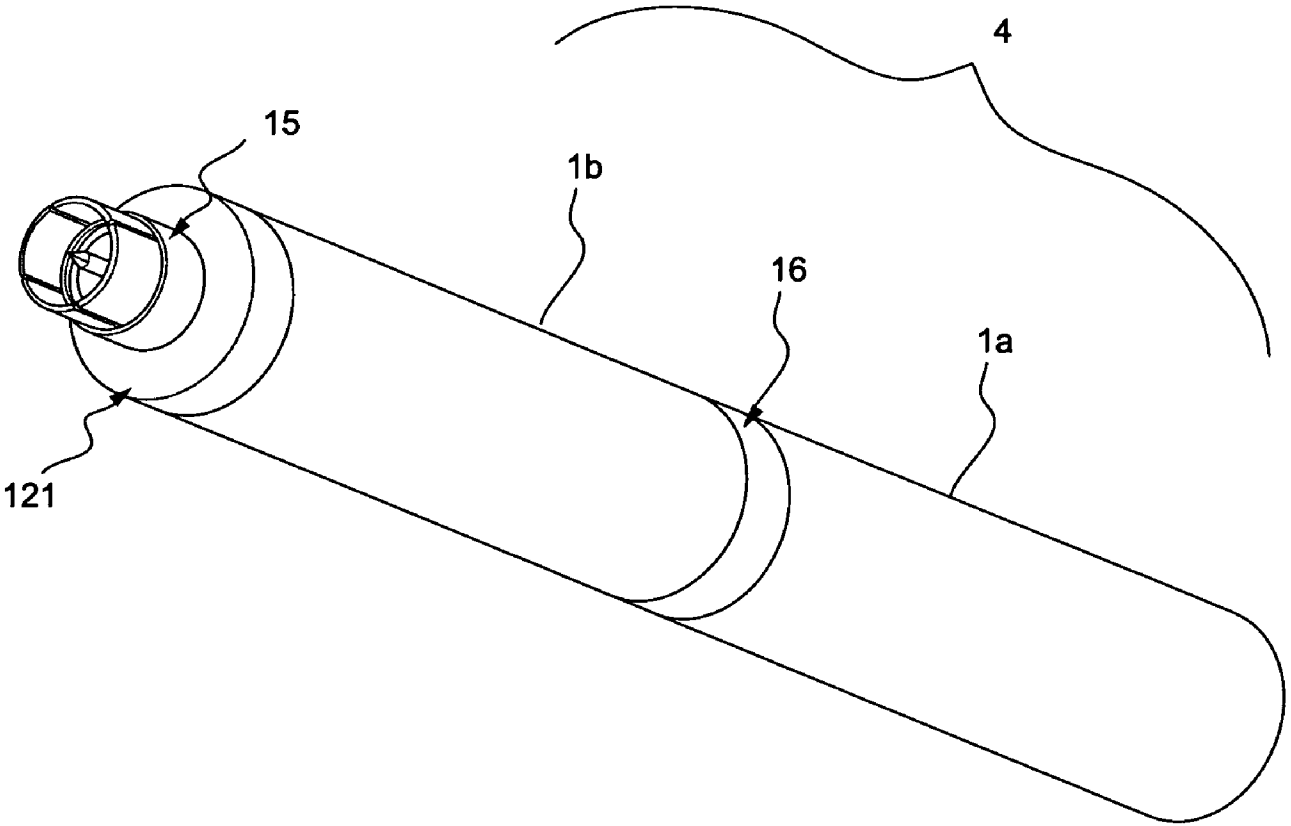
Figure 6:
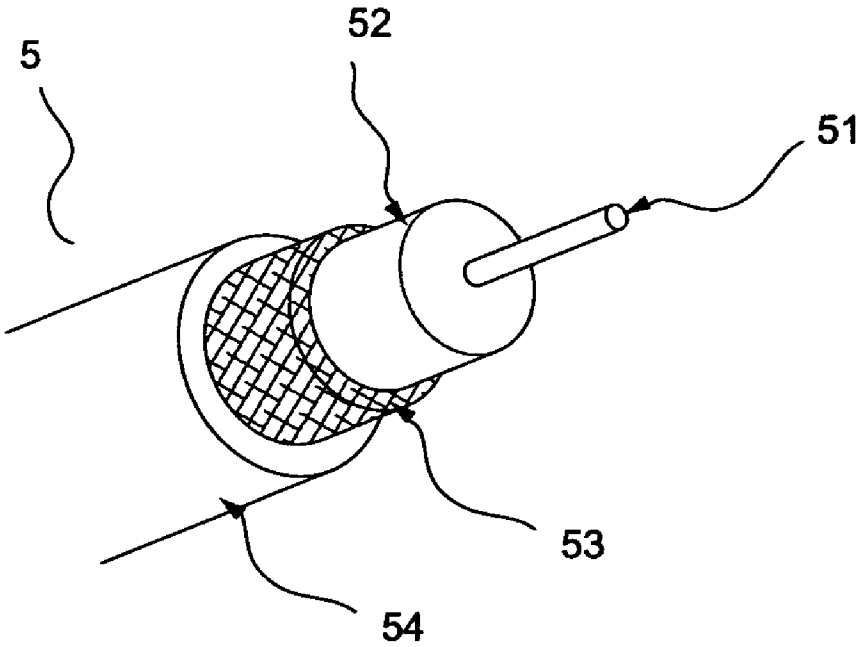
FIG. 6 is the illustrative schematics showing the structure of the conventional coaxial cable.

The special structural design of the RF antenna 4 as one feature in the present invention is to let both of the lower antenna tube 1*a* and upper antenna tube 1*b* serve as each opposite pole of the dipole antenna as shown in the FIG. 3; additionally, by sleeve coaxial construction of different diameter in between of internal waveguide pipe 12 and external upper antenna tube 1*b*, the effect is equivalent double folded antenna as shown in the FIG. 4. Since the relay conductor 14 centrally passes the waveguide pipe 12 in coaxial manner with inner air cylinder layer in between relay conductor 14 and waveguide pipe 12 as well as outer air cylinder layer in between waveguide pipe 12 and upper antenna tube 1*b*; Equivalently, comparing to the conventional coaxial cable 5 (as shown in the FIG. 6), the relay conductor 14 is analogous to main core conductor 51, likewise, the inner air cylinder layer in between relay conductor 14 and waveguide pipe 12 is analogous to inner dielectric insulator 52, the waveguide pipe 12 is analogous to metallic mesh shield 53, the outer air cylinder layer in between waveguide pipe 12 and upper antenna tube 1*b* is analogous to outer insulation sheath 54 too. By analogizing the shielding and suppressing effect in the interference EMF noise by the coaxial cable 5, the special structural design of the RF antenna 4 in the present invention do have same shielding and suppressing effect in the interference EMF noise so as to maintain low attenuation of the radio signal. Actually, owing to both of inner and outer air cylinder layers being served as dielectric media to replace plastic insulation layer, not only the manufacturing cost can be reduced but also the manufacturing process can be simplified with elimination of plastic material so that having real effect in environmental protection.

Moreover, both of the relay conductor 14 and propagating conductor 23 are made of rigid metal without bend after frequent use in contrast to the flexibility of main core conductor 51 in the coaxial cable 5. With such permanent rigid straight form in both of the relay conductor 14 and propagating conductor 23, any abnormal short circuit with surrounding waveguide pipe 12 or column lock shank 21 can be avoided. Comparatively, owing to most components of the RF antenna 4 being made of rigid metal instead of flexible material as those of coaxial cable 5, the structure of the RF antenna 4 is more firm and hard than coaxial cable 5.

Thus, by means of all the technical measures disclosed above, the electronic seal with radio frequency identification of the present invention has advantages such as simple construction, EMF noise-resistant performance with similar transmission function as conventional coaxial cable, reducing use rate of plastic material and the like so that it indeed has positive effect in cost reduction, energy conservation and environmental protection as well as improvement in the procedure and cost for container transportation, especially during such society of constant-rising in material and increasingly severe-wastage of energy as today. In conclusion, the special design in the electronic seal with radio frequency identification of the present invention possesses innovative novelty, non-obviousness beyond prediction of prior arts and practical usage in industrial application, which meets the essential criterion of the patentability. Accordingly, for encouraging motivation in creative invention, please your honorable examiners grant us patent, which will be greatly appreciated. However, all the drawings, description disclosed heretofore in the specifications are only an exemplary preferred embodiment, which is not intended to limit our patent scope. Therefore, any minor or equivalent modification, change and replacement, which can be done by ordinary skilled person in this field in accordance with the essence and spirit therein, should be still deemed in the range and scope of the patent claims of the present invention.

What is claimed is:

1. An "electronic seal with radio frequency identification" mainly comprises a lock cylinder and a lock latching plug to form an integral lock portion, which having RF chip, RF antenna with associated electric circuits, conductors and RF chip with necessary data to be captured by external reader, wherein the lock cylinder comprises a metal lower antenna tube and a metal upper antenna tube to form each opposite pole of the dipole antenna and build the main portion as a simple and reinforced robust structure.

2. The "electronic seal with radio frequency identification" as recited in claim 1, wherein, said upper antenna tube together with an insulation terrace gasket and a barrel shell surrounding outer, disposed on the lower end of said upper antenna tube is a RF feed disk, whereon a RF feed point is indented in the center; centrally suspended inside of said upper antenna tube is a metal waveguide pipe having its lower end firmly fixed a coupling washer to joint with said upper antenna tube such that its upper end protruding over said upper antenna tube.

3. The "electronic seal with radio frequency identification" as recited in claim 2, wherein, on the upper rim of said waveguide pipe is a receptacle chuck that is to be connected with external electronic device for feeding coaxial signal inwardly.

4. The "electronic seal with radio frequency identification" as recited in claim 1, wherein, said lock latching plug comprises a latching butt cap and a wrapped-in hollow metal column lock shank.

5. The "electronic seal with radio frequency identification" as recited in claim 4, wherein, a rigid metal propagating conductor is centrally positioned in the hollow space of said column lock shank.

6. The "electronic seal with radio frequency identification" as recited in claim 1, wherein, both of said relay conductor and propagating conductor are made of rigid metal in slender column.

7. The "electronic seal with radio frequency identification" as recited in claim 5, wherein, said relay conductor is fixed by insulation ferrule together with insulation terrace gasket, and said propagating conductor is fixed by groove rim.

* * * * *